US005733373A

United States Patent [19]

Meyer et al.

[11] Patent Number: 5,733,373

[45] Date of Patent: Mar. 31, 1998

[54] PRESSURE STRIP FOR COATING DEVICE

[75] Inventors: Runald Meyer, Heinzenbach; Reinhard Knop, Essen, both of Germany

[73] Assignee: Jagenberg Aktiengesellschaft, Dusseldorf, Germany

[21] Appl. No.: 493,960

[22] Filed: Jun. 23, 1995

Related U.S. Application Data

[63] Continuation of Ser. No. 140,125, Oct. 27, 1993, abandoned.

[30] Foreign Application Priority Data

Mar. 11, 1992 [DE] Germany ..... 42 07 731.1

[51] Int. Cl.[6] ..... B05C 21/00

[52] U.S. Cl. ..... 118/123; 118/100; 118/122; 118/126; 15/256.5; 15/256.51

[58] Field of Search ..... 118/123, 126, 118/122, 100; 15/256.5, 256.51; 162/281; 100/174; 101/162

[56] References Cited

U.S. PATENT DOCUMENTS

| | | | |
|---|---|---|---|
| 2,915,421 | 12/1959 | Miller | 15/256.51 |
| 3,113,890 | 12/1963 | Johnson et al. | 15/256.51 |
| 3,182,632 | 5/1965 | Vazdikis | 118/126 |
| 4,407,221 | 10/1983 | Peel | 118/122 |
| 4,899,687 | 2/1990 | Sommer et al. | 118/126 |

FOREIGN PATENT DOCUMENTS

| | | |
|---|---|---|
| 0307618 | 3/1989 | European Pat. Off. . |
| 2825907 | 12/1979 | Germany . |
| 3927329 | 2/1991 | Germany . |
| 3934986 | 4/1991 | Germany . |
| 9112595 | 11/1991 | Germany . |

*Primary Examiner*—Laura Edwards

*Attorney, Agent, or Firm*—Herbert Dubno; Yuri Kateshov

[57] ABSTRACT

A doctor blade assembly for coating a traveling web has a blade which is held against movement away from the web or a coating drum or cylinder by a pressure strip bearing with its contact edge against the doctor blade. The pressure strip can be adjusted by spaced part rods and adjusting nuts against a spring force.

9 Claims, 2 Drawing Sheets

PRESSURE STRIP FOR COATING DEVICE

This is a continuation of application Ser. No. 08/140,125, filed on Oct. 27, 1993, now abandoned.

CROSS REFERENCE TO RELATED APPLICATION

This application is a national phase of PCT/EP 93/00031 filed Jan. 9, 1993, and based in turn, upon German national application P 42 07 731.1 filed Mar. 11, 1992.

1. Field of the Invention

The invention relates to a pressure strip for a doctor blade in a device for coating running webs of material, particularly paper or cardboard webs which has a rounded or sharp edge meant to rest against the doctor blade and which is elastically bendable over its length for setting a locally variable contact pressure. The invention also relates to a device for coating a running web of material using such a pressure strip.

2. Background of the Invention

There are known devices for coating paper or cardboard webs which have a coating mechanism (cylinder or nozzle coating mechanism), by means of which the coating material, e.g. coating paint, is applied in excess to the web. A dosing system with a doctor blade as dosing element is provided downstream of the coating mechanism and wipes off the excess, until the coating reaches the desired weight. The coating weight can be adjusted through the contact pressure of the doctor blade against the cylinder. Under its point the doctor blade is supported by a pressure strip resting against it, and the contact pressure can be modified by sliding and/or swinging the clamped doctor blade end.

During the coating of paper or cardboard webs, due to production conditions, variations occur in the web cross section which require different settings of the doctor blade over the work width in order to obtain a uniform coating. In this respect it is known from German Patent 28 25 907 to adjust a pressure strip which is bendable within limits by means of traction and pressure screws, along the support line, depending upon whether the coating weight at the respective points is too high or too low.

The DE-OS 39 27 329 describes a generic coating device wherein the adjustment elements are piezo-translators. According to one embodiment adjustable-force springs act against the contact pressure of the pressure strip with piezo-translators.

In practice the controlled bending of the doctor blade over the work width for the purpose of setting a uniform coating profile at high web speeds has proven to be very difficult. There are forces acting from the web coated with an excess of coating material upon the doctor blade, pushing it away from the cylinder, which have to be absorbed without endangering the uniformity of the coating.

OBJECT OF THE INVENTION

It is an object of the invention to provide an improved pressure strip which makes possible a locally variable setting of the contact pressure of the doctor blade, without the occurrence of disturbances in the uniformity of the coating at high web speeds due to the forces acting upon the doctor blade.

A further object of the invention is to provide an improved coating device wherein by means of simple construction it is possible to set a locally variable and very precise contact pressure of the doctor blade over the work width.

SUMMARY OF THE INVENTION

This object is achieved with a pressure strip for coating a travelling web wherein surface inertia moment $I_x$ of the pressure strip measured perpendicularly to the flexure plane ranges between 100 $mm^4$ and 5000 $mm^4$, preferably between 800 $mm^4$ and 1200 $mm^4$. On the one hand the pressure strip is so flexible that a fine, sensitive setting of the contact pressure becomes possible, on the other hand it is sufficiently stiff to absorb the forces acting upon the doctor blade, without disturbances in the coating weight.

A device for coating a running web of material, particularly a paper or cardboard web, has a cylinder guiding the web of material, a doctor blade which can be pressed against the cylinder and a bendable pressure strip pressing against the doctor blade under its point and supporting the doctor blade. A row of adjusting elements is arranged over the work width which, in order to set a locally variable contact pressure of the doctor blade, engage in the pressure strip at its side facing away from the doctor blade. The pressure strip has the surface inertia moment Ix described above and the adjusting elements have a distance from each other of 50 mm to 200 mm, particularly 70 mm to 120 mm.

The adjusting elements can be characterized by:

(a) an axially slidable adjusting rod fastened to the backside of the pressure strip which is guided through a holder;

(b) over the end of the adjusting rod a spring washer is pulled which on the one side rests against the holder while on the other side it is stressed by a setting nut screwed to the adjusting rod; and (c) an adjustable screw coaxial with the adjusting rod which presses in the direction of the cylinder against the force of the spring.

In the device, the distance between the individual setting points is thus selected so that the flexibility of the pressure strip lies within a range which insures a fine, sensitive setting of the contact pressure, as well as sufficient stability.

The arrangement of the adjusting elements ensures that the pressure strip can be locally flexed in a different manner. Without high construction expenditures, the adjusting elements make possible a play-free setting of the pressure strip.

According to the invention, the screw is threaded into the inner thread of a further coaxial screw, whereby the inner thread of the adjusting screw has a different pitch than its outer thread and the inner screw can be prevented from corotating by detachable elements such as a cover. This particularly advantageous embodiments allows for a rough and for a fine setting, the latter based on the principle of differential screws. A further advantage is that during the rough setting without differential effect a reproducible reference position can be set, which can be subsequently used for the fine adjustment when the differential effect is triggered.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
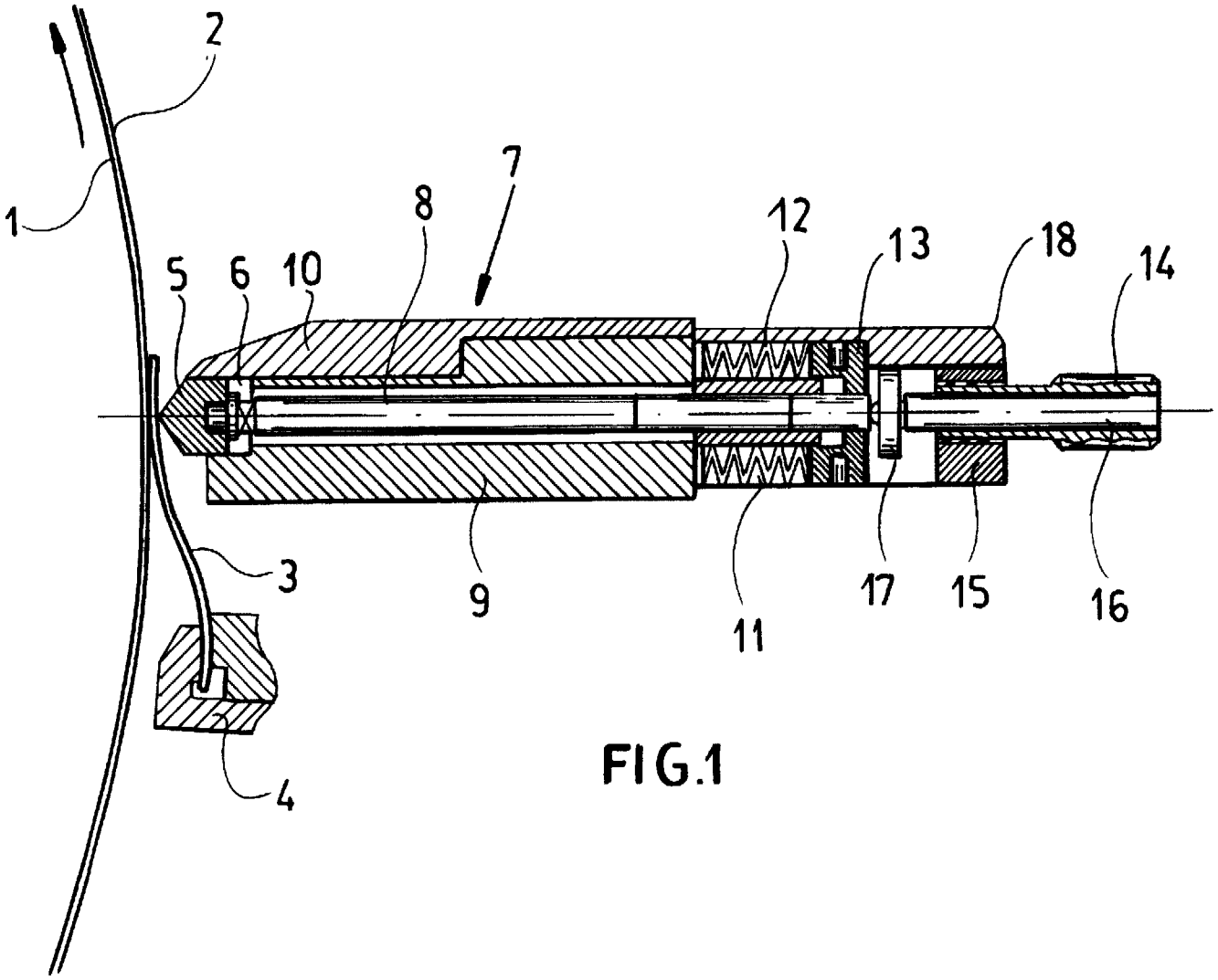
FIG. 1 is a longitudinal section through a pressure strip with the adjusting elements according to the invention and FIG. 2 is a partially sectioned perspective view.

The coating device has a driven cylinder 1 which guides the web of material 2, e.g. an 8 m wide paper or cardboard web. The web of material 2 has been coated in excess with a coating material by a device not shown in the drawing, this coating material being wiped off by a dosing system with an elastically bendable doctor blade 3 as a dosing element, until the desired coating weight is reached. The doctor blade 3 is securely clamped with its end in a clamping bar 4 displaceable in the direction of the cylinder 1, and on its side facing away from the cylinder 1 under the doctor blade point it is supported by a pressure strip 5 which is elastically bendable within limits. The contact pressure of the doctor blade 3 against the cylinder 1 can be adjusted by a relative displacement of the clamping bar 4 with respect to the pressure strip 5 extending over the web width.

The pressure strip 5 has a uniform cross section over its entire length, which corresponds to the maximal web width and thereby to the axial length of cylinder 1. The edge of the pressure strip 5, resting against the doctor blade 3 is sharp or rounded with a radius between 1 mm and 3 mm, in the example 2 mm. On the side facing away from the doctor blade 3 the cross section of the pressure strip 5 is rectangular and fits the groove 6 of its holder 7 open towards the doctor blade 3, wherein the pressure strip 5 is supported so as to be radially movable with respect to the cylinder 1. The width of the pressure strip 5 measured tangentially to the cylinder 1 equals approx. 20 mm, its radially measured thickness of the part with the rectangular cross section equals approx. 10 mm. Preferably it is made of chromium nickel steel, but it can also be made for instance of carbon-fiber reinforced plastic material and/or provided with a wear-resistant coating. The guidance of the holder 7 in the groove 6 makes possible a bending of the pressure strip 5 in a flexure plane running approximately radially to the cylinder 1. In order to permit the finest possible adjustment of the contact line at the doctor blade 3, without disturbing counter forces, the surface moment of inertia or polar moment of inertia $I_x$ of the pressure strip 5 measured perpendicularly to the flexure plane ranges between 100 $mm^4$ and 5000 $mm^4$, preferably between 800 $mm^4$ and 1200 $mm^4$; in the present example it equals 1000 $mm^4$.

As can be seen especially from FIG. 1, the groove 6 in the holder 9, 10 has a pair of parallel sides which engage the parallel flanks of the rectangular portion of the otherwise pentagonal cross section pressure strip 5 which is engaged directly by the rods 8 at its side opposite the inclined flanks which form the contact edge.

In order to be able to bend the pressure strip 5 across the working width for the setting of a desired cross section of the coating weight via a locally variable contact pressure of the doctor blade 3, on its back side, over the entire working width, at equal distances—in the example all of 75 mm—bores are provided and the end of an adjustment rod 8 is screwed in each of these bores. The adjusting rods are guided so as to be freely movable in the axial direction in the bores of the base plate 9 of holder 7, which at its end facing towards the doctor blade 3 has a rectangular cutout upwardly covered by a cover plate 10 connected by screws to the base plate 9, in order to form the groove 6.

A sleeve 11 is pulled over the end of each adjustment rod 8 protruding from the bore of the base plate 9, this sleeve resting against the base plate 9 with a bulb-like widened portion. Over the sleeve 11 at least one spring washer 12 is fitted, which on one side rests against the bulb-like portion and on the other side against a setting nut 13, which is mounted on the end of the adjustment rod 8. The setting nut 13 has a bore fitting the diameter of sleeve 11, so that it can be moved over the sleeve 11, in order to set the initial stress of the spring washer 12 by rotation of the nut. The spring washer 12 pushes the adjustment rod 8 away from cylinder 1 with the preselected initial stress, thereby pulling the pressure strip 5 in order to reduce the contact pressure at the doctor blade 3.

Figure 2:
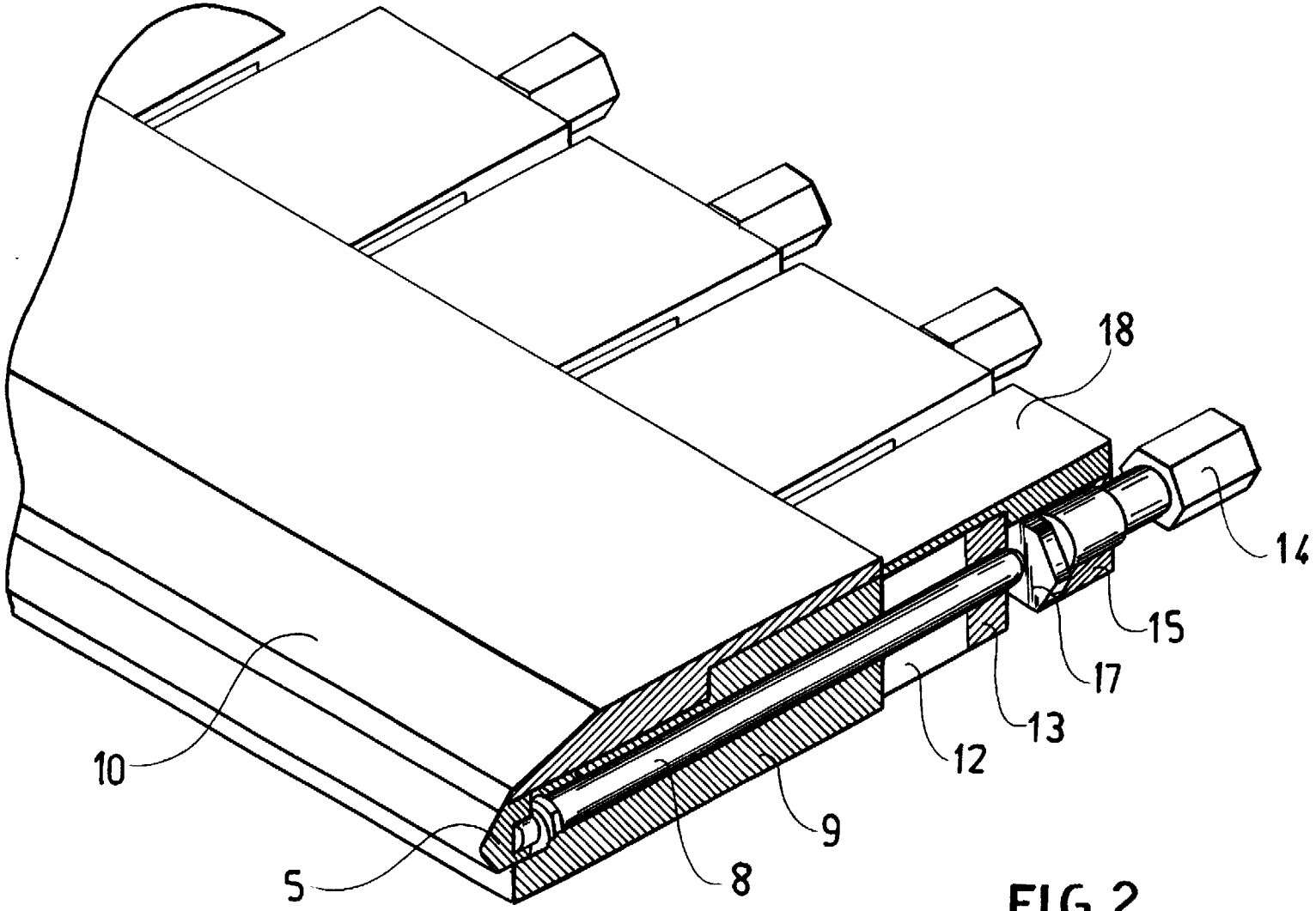

In order to move the rod 8 in the direction towards the cylinder 1 and back, an adjusting screw 14 is provided with a threaded inner bore and an additional outer thread by means of which it is screwed into the threading of a holder 15 fastened to the base plate 9. Coaxially with the adjustment rod 8, in the traversing inner thread a further screw 16 is fitted, which is movable by turning against the end of the adjustment rod 8 in the direction of cylinder 1. To the end of screw 16 a disk 17 with a polygonal cross section—a hexagonal cross section in the example—is fastened, which presses against the end of the adjusting rod 8 via a centrally fastened spherical cap, in order to keep the friction as low as possible during the turning of the screw 16. A cover 18 which can be tightly bolted to the upper side of holder 15 reaches from there over the disk 17, the setting nut 13 and the spring washer 12 to the cover plate 10, in order to seal the adjusting elements on the upper side. At the same time its even underside is fitted to the edges of disk 17 and presses form-lockingly against its circumference, in order to prevent the corotation of the disk 17, and thereby of the screw 16, when the adjusting screw 14 is turned. As shown in FIG. 2, each adjusting element has its own cover 18 which can be screwed off, in order to make possible the corotation of screw 16 during the coarse setting by removing a cover 18, as subsequently closer described. In order to permit the finest possible setting based on the principle of differential screws, the outer thread of adjusting screw 14 has a smaller pitch than its inner thread, which corresponds to the outer thread of screw 16. The screw 16 is somewhat longer than the adjusting screw 14 in which it is supported. Its outer frontal face can thereby be brought into congruence with the outer frontal surface of adjusting screw 14, in order to establish a reference point.

The setting of a preselected curvature of the pressure strip 5 for the uniformity of the coating cross section is performed as follows:

First with the covers 18 removed, the adjusting nuts 13 are turned on the adjusting rods to establish an axial position, wherein the preselected initial stress of spring washers 12 is reached. In the basic position the outer frontal faces of screws 16 are congruent with the outer frontal faces of adjusting screws 14. The rough setting takes place in such a manner that the adjusting screws 14 are each turned with removed covers 18 until the reference position is reached. Thereby, with the spherical caps the disks 17 press adjusting rods 8 in the direction of cylinder 1, against the spring force of the spring washers 12. The screw 16 rotates together with the adjusting screw 14, since the friction at the spherical caps of disk 17 is negligible in comparison with the friction in the common thread with the adjusting screw 14. When the desired reference position for the fine setting is reached, the covers 18 are put on and tightly screwed, preventing from now on a corotation of the screw 16. Thus the pressure strip is pentagonal with a triangular section adjoining the rectangular cross section. With a further turn of the adjusting screw 14 the subordinated screw 16 changes from now on its axial position with respect to the adjusting screw 14 depending on the pitch of the common thread. The disk 17 moves now to or from the adjusting bar 8 only with the difference between the thread pitch outside and inside the adjusting screw 14, whereby a very fine adjustment of the pressure strip 5 in the respective areas becomes possible. The adjustment mechanism of pressure strip 5 is play-free, since the adjustment always takes place with or against the prestressed spring force of the mentioned spring washers 12. When the adjustment direction of the adjusting rods 8 changes, the force flow does not change as in the known adjusting screws.

Furthermore the reference point selected for the rough setting can be simply reproduced, by turning the adjusting screw 14 so much until the frontal face is again congruent with the frontal face of screw 16. For a more precise setting of the reference point, on the frontal faces of both screws 14, 16 marks can be made which can be brought into congruency.

We claim:

1. A doctor blade assembly for coating a traveling web of material, comprising:

a doctor blade in the form of a flexible strip extending across a web width and having a free edge and another edge;

means engaged with said other edge for controlling pressing of said blade against said traveling web; and a pressure strip elastically bendable over a length thereof and bearing against said blade with a contact edge of said pressure strip between said free edge and said other edge of said blade for locally varying a contact pressure of said blade against said web, said pressure strip being of pentagonal cross section with a triangular cross section portion forming said contact edge and adjoining a rectangular cross section portion, said pressure strip having a surface moment of inertia $I_x$ measured perpendicular to a flexure plane thereof ranging between 100 $mm^4$ and 5000 $mm^4$.

2. The doctor blade assembly defined in claim 1 wherein said surface moment of inertia $I_x$ is between 800 $mm^4$ and 1200 $mm^4$.

3. The doctor blade assembly defined in claim 2 wherein said contact edge has a radius between 1 mm and 3 mm.

4. An apparatus for coating a traveling web of material, comprising:

a cylinder against a surface of which a traveling web to be coated is guided;

a doctor blade assembly juxtaposed with the cylinder and comprising:

a flexible doctor blade of a length extending across a width of said web and having a free edge and another edge, means supporting said other edge for controlling pressing of said blade against said traveling web, and a pressure strip elastically bendable over a length thereof and bearing against said blade with a contact edge of said pressure strip between said free edge and said other edge of said blade for locally varying a contact pressure of said blade against said web, said pressure strip being of pentagonal cross sectional configuration with said contact edge being defined by two converging flanks and having two mutually parallel flanks;

a housing having a groove opening toward said cylinder and receiving said pressure strip, said groove having parallel walls contacting said parallel flanks; and a row of adjusting elements spaced apart in said housing across said width with a spacing of 50 mm to 200 mm, engaging a side of said pressure strip turned away from said blade, and setting a local contact pressure of said pressure strip with said blade and said blade against said web, said adjusting elements including screw-thread controlled spring-loaded rods bearing directly against said pressure strip, said contact edge having a radius between 1 mm and 3 mm.

5. An apparatus for coating a traveling web of material, comprising:

a cylinder against a surface of which a traveling web to be coated is guided;

a doctor blade assembly juxtaposed with the cylinder and comprising:

a flexible doctor blade of a length extending across a width of said web and having a free edge and another edge, means supporting said other edge for controlling pressing of said blade against said traveling web, and a pressure strip elastically bendable over a length thereof and bearing against said blade with a contact edge of said pressure strip between said free edge and said other edge of said blade for locally varying a contact pressure of said blade against said web;

a holder for said pressure strip and including a housing receiving said pressure strip;

a row of adjusting elements spaced apart across said width in said housing and each including:

an axially slidable adjusting rod directly engaging a side of the pressure strip turned away from said web, spring means in said housing including at least one spring washer fitted over an end of said rod, braced against said holder and bearing upon a setting nut threaded onto said rod, and an adjustable screw in said housing pressing against said rod opposite to a force of said spring means thereon in a direction toward said cylinder, said housing having a groove opening toward said cylinder and formed with parallel sides, said pressure strip being of pentagonal cross sectional configuration with said contact edge being defined by two converging flanks and having two mutually parallel flanks, said pressure strip being received in said groove with said parallel flanks in contact with said parallel sides.

6. The apparatus defined in claim 5 wherein each adjustable screw is threaded into a differential screw having internal and external threads of different pitch, means being provided for limiting rotation of said adjustable screw in said differential screw.

7. The apparatus defined in claim 6 wherein said row of adjusting elements are spaced apart across said width with a spacing of 50 mm to 200 mm.

8. The apparatus defined in claim 7 wherein said spacing is 70 to 120 mm.

9. The apparatus defined in claim 8 wherein said contact edge has a radius between 1 mm and 3 mm.

* * * * *